United States Patent [19]

Uchinishi

[11] 4,178,886

[45] Dec. 18, 1979

[54] TWO STROKE ENGINES

[75] Inventor: Eizaburo Uchinishi, Kakogawa, Japan

[73] Assignee: Kawasaki Jukogyo Kabushiki Kaisha, Hyogo, Japan

[21] Appl. No.: 769,700

[22] Filed: Feb. 17, 1977

[30] Foreign Application Priority Data

Feb. 18, 1976 [JP] Japan ..... 51-17709

[51] Int. Cl.[2] ..... F02B 33/04

[52] U.S. Cl. ..... 123/73 A; 123/73 B

[58] Field of Search ..... 123/73 R, 73 A, 73 B, 123/73 V, 73 PP

[56] References Cited

U.S. PATENT DOCUMENTS

| | | | |
|---|---|---|---|
| 3,107,659 | 10/1963 | Steinlein et al. | 123/73 V |
| 3,687,118 | 8/1972 | Nomura | 123/73 A |
| 3,815,558 | 6/1974 | Tenney | 123/73 A |
| 3,905,340 | 9/1975 | Boyesen | 123/73 A |
| 3,934,562 | 1/1976 | Isaha | 123/73 R |

*Primary Examiner*—Charles J. Myhre
*Assistant Examiner*—David D. Reynolds
*Attorney, Agent, or Firm*—Stevens, Davis, Miller & Mosher

[57] ABSTRACT

Two stroke engines of the crankchamber precompression type are described which include an intake port leading from the intake passage and cyclically opened to the crankchamber by means of the piston. Auxiliary intake passages extend between the intake passage and the scavenging passages and include reed type check valves so that the intake mixture is introduced into the crankchamber as soon as the piston upward movement starts. Additional mixture can also be supplied through the auxiliary passages in the scavenging stroke of the engine operation.

8 Claims, 7 Drawing Figures

TWO STROKE ENGINES

The present invention relates to crankchamber precompression type two stroke engines and more particularly to intake means therefor.

Conventional two stroke engines of this type include an intake passage connected with the engine crankchamber to provide a supply of air-fuel mixture thereinto. The crankchamber is connected with the combustion chamber defined at the upper portion of the cylinder through scavenging passages and scavenging ports which open to the wall surface of the cylinder. In the ascending stroke of the piston movement, the air-fuel mixture is introduced through the intake passage into the crankchamber. As the piston moves downwards, the mixture which has been introduced into the crankchamber is compressed in the chamber and forced to flow through the scavenging passages into the combustion chamber as soon as the scavenging ports have been opened.

In order to prevent the mixture in the crankchamber from flowing back to the intake passage during the descending or downward stroke of the piston, it has already been known to open the intake passage to the crankchamber through an intake port which is formed in the lower part of the cylinder and adapted to be closed by the piston skirt in the descended position of the piston.

In this type of intake means, hereinafter referred to as "piston valve type," the time interval in which the intake port is open can be determined by the position of the intake port and the dimension of the piston skirt. The shorter the period the piston valve is open the less is the blow-back of the intake mixture into the intake passage; however, there will be a decrease in the amount of the charge of the mixture so that the engine output will correspondingly be decreased. By increasing the period during which the piston valve is open, it is possible to increase the engine output but there will be an increased possibility of engine intake mixture blow-back, particularly in the lower speed range of engine operation.

In order to eliminate the disadvantages of the piston valve type intake system, it has been proposed and widely employed to open the intake passage to the crankchamber through a one-way valve, such as a reed type check valve. In the intake system having such a one-way valve in the intake passage, the mixture starts to flow from the intake passage into the crankchamber as soon as the piston starts to move upwards. Further, the back flow of the mixture can be effectively prevented.

In this type of engines, however, inconveniences have been encountered in that particular consideration must be made in the engine crankcase for providing structural means to accommodate the one-way valve and associated intake passage parts. Thus, the overall structure becomes complicated and the bulkiness of the crankcase must be further increased. Further, since the intake mixture is always passed through the one-way valve before it is introduced into the crankchamber, the flow of the intake mixture is subjected to a resistance by the valve. The resistant applied by the one-way valve to the flow of the intake mixture becomes significant particularly in the high speed range of the engine operation so that the engine output is undesirably limited. Further, in this type of engines, it is difficult to obtain an adequate response in rapid acceleration.

In Japanese patent publication Sho No. 37-17605, which corresponds to U.S. Pat. No. 3,107,659, there is disclosed a two stroke engine in which the intake passage is connected through reed type valves to scavenging passages extending between the crankchamber and the scavenging ports so that the mixture is introduced from the intake passage through the lower portions of the scavenging passages to the crankchamber during the upward stroke of the piston movement. In this arrangement, a supply of intake mixture is maintained from the intake passage as well as from the crankchamber through the scavenging passages and the scavenging ports into the combustion chamber in the downward stroke of the piston movement. Since the mixture supplied from the intake passage through the scavenging passages and the scavenging ports provides an additional charge, the overall engine output can be increased. However, since the mixture is necessarily passed through the reed type valves before it is introduced into the combustion chamber, there still is an undesirable restriction on the engine output and an adequate response cannot be obtained in acceleration.

The present invention has therefore an object to provide an improved intake means for two stroke engines.

Another object of the present invention is to provide intake means for two stroke engines in which flow resistance to intake mixture flow can be maintained as small as possible and which can provide an increased charge of intake mixture for high engine output.

According to the present invention, the above and other objects can be accomplished by two stroke engines comprising cylinder means, crankchamber means provided beneath the cylinder means, piston means disposed in said cylinder means for reciprocating movement, combustion chamber means defined in the cylinder means by said piston means, scavenging port means provided in said cylinder means and adapted to cooperate with said piston means so as to be cyclically opened to said combustion chamber means, scavenging passage means extending between said scavenging port means and said crankchamber means, intake port means provided in said cylinder means and adapted to cooperate with said piston means so as to be cyclically opened to said crankchamber means, intake passage means connected with said intake port means, auxiliary passage means extending between the intake passage means and said scavenging passage means and including one-way valve means which allows gas flow only toward the scavenging passage means.

According to the features of the present invention, substantial part of the intake mixture is introduced into the crankchamber so that an improved engine response can be obtained in acceleration. Additionally, the intake mixture is also introduced through the auxiliary passage means into the crankchamber in upward stroke of the piston movement so that it is possible to increase the total amount of charge of the mixture into the crankchamber as compared with that in engines having only piston valve type intake means. Further, in the downward stroke of the piston movement, the intake mixture is introduced into the combustion chamber from the intake passage through the auxiliary passage means, in addition to the mixture from the crankchamber, to provide an increased engine output.

A further advantage of the present invention is that the auxiliary passage means can be provided within the confine of the crankcase in the plan view of the engine so that no additional space is required for employing the concept of the present invention.

According to a preferable aspect of the present invention, the scavenging passage means includes at least two scavenging passages which are disposed at the opposite sides of the cylinder means and the auxiliary passage means includes a corresponding number of branched passages respectively leading to the scavenging passages.

The above and other objects and features of the present invention will become apparent from the following descriptions of preferred embodiments taking reference to the accompanying drawings, in which.

Figure 1:
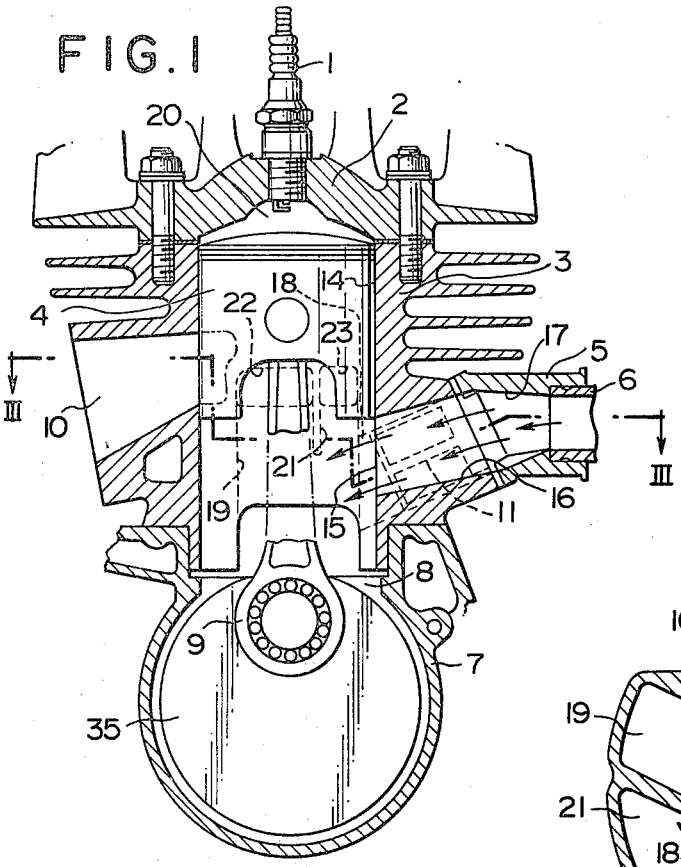
FIG. 1 is a vertical sectional view of a two stroke engine in accordance with one embodiment of the present invention.
Figure 3:
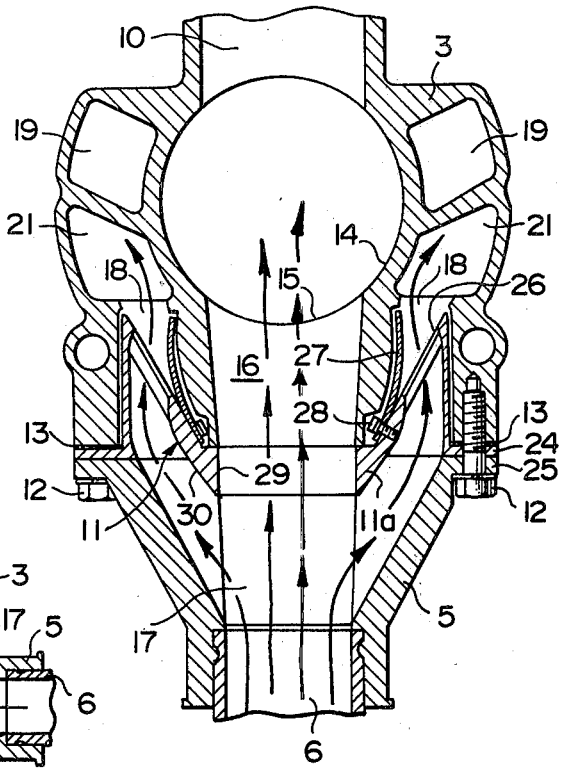
FIG. 3 is a sectional view taken substantially along the line III—III in FIG. 1 illustrating the flow of fuel mixture during the upward stroke of the piston.
Figure 2:
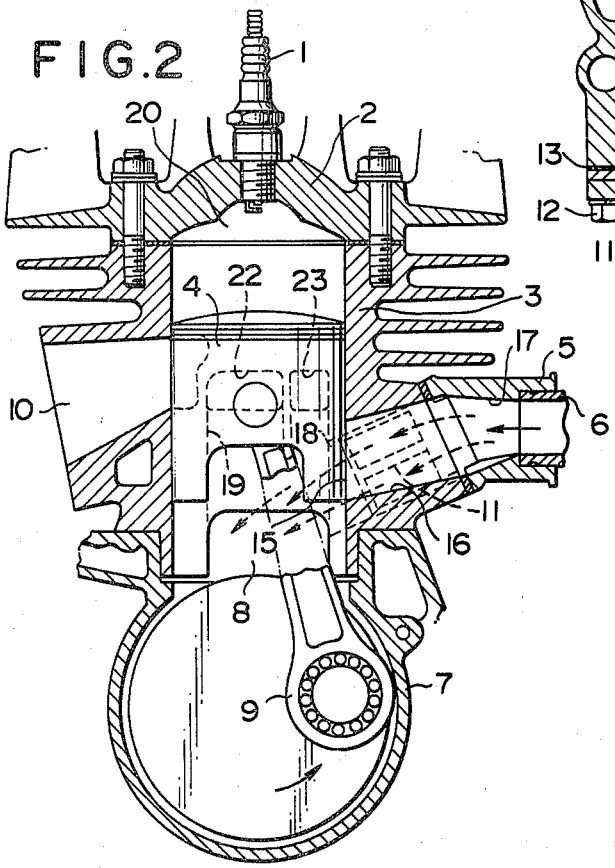
FIG. 2 is a vertical sectional view similar to FIG. 1 but showing the piston in a different position.

Referring now to the drawings, particularly to FIGS. 1 through 3, the two stroke engine shown therein comprises a cylinder 3 having a cylinder head 2 secured thereto by means of a plurality of bolts. An ignition plug 1 is attached to the cylinder head 2 in a manner well known in the art. Within the cylinder 3, a piston 4 is disposed for reciprocating movement. Thus, a combustion chamber 20 is defined in the cylinder 3 between the cylinder head 2 and the piston 4.

A crankcase 7 is attached to the lower end of the cylinder 3 to define a crankchamber 8. In the crankchamber 8, there is disposed a crankshaft 35 which is connected through a connecting rod 9 with the piston 4.

The cylinder 3 has formed at its wall surface 14 an exhaust port 10 and a plurality of scavenging ports 22 and 23 which co-operate with the piston 4 so that they are cyclically opened to the combustion chamber 20 as the piston reciprocates. The scavenging ports 22 and 23 are connected through scavenging passages 19 and 21 with the crankchamber 8.

The cylinder 3 is also formed at its lower portion with an intake port 15 which co-operates with the piston 4 so that it is cyclically opened to the crankchamber 8. The intake port 15 is in communication with an intake passage 16 formed in the cylinder 3 itself and a further intake passage 17 formed in a conduit block 5 attached to the cylinder 3. The conduit block 5 carries a carburetor 6 which may be of a conventional type and may include a throttle valve (not shown).

The intake passage 17 in the conduit block 5 leads to a pair of auxiliary intake passages 18 which is disposed at the opposite sides of the intake passage 16 and connected with the scavenging passages 21. In the auxiliary passages 18, there is disposed a reed type check valve assembly 11 which includes a valve casing 11*a* having a peripheral flange 24 which is secured to the cylinder 3 by the flange 25 on the conduit block 5 and a plurality of fastening bolts 12. A fluid sealing gasket 13 is interposed between the flange 24 and the cylinder 3.

The valve casing 11*a* has valve seats 26, one for each passage 18 and valve reeds 27 are attached to the valve casing by means of bolts 28 for co-operation with the valve seats 26. The valve casing 11*a* is formed with a guide surface 29 which is in alignment with the wall surface of the intake passage 16. The valve casing 11*a* is further formed with guide surfaces 30 for each passage 18. It should be noted that the passages 18 are formed within the confine of the crankcase as seen in plan view so that the provision of the passages 18 does not increase the space occupied by the engine.

Figure 6:
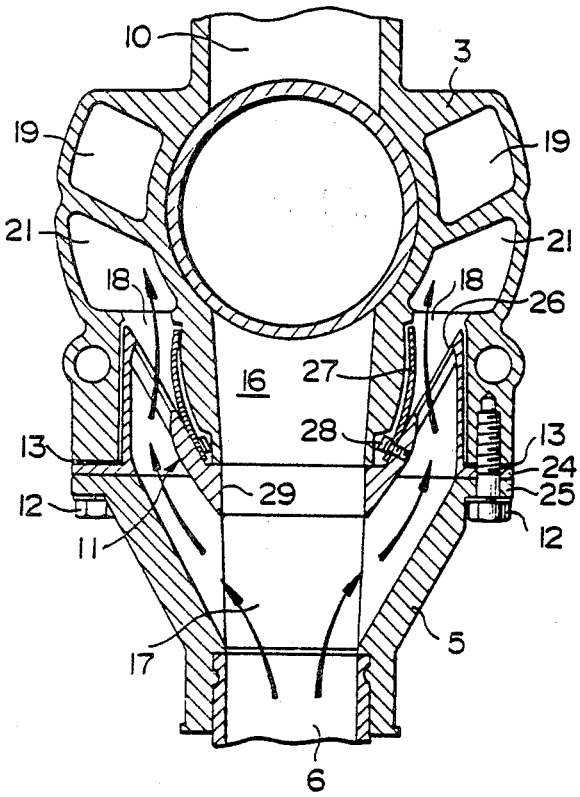
FIG. 6 is a sectional view similar to that of FIG. 3, but showing the flow of fuel mixture as the piston begins its upward stroke.

In operation of the engine, as illustrated in FIG. 6, air-fuel mixture is introduced, as soon as the upward stroke of the piston movement starts, through the intake passage 17 and the passages 18 into the crankchamber 8. As illustrated in FIG. 3, when the piston 4 moves upwards by a predetermined distance, the intake port 15 is opened and air-fuel mixture is additionally introduced through the intake port 15. It should be noted that in the engine in accordance with the present invention, the intake stroke into the crankchamber 8 starts earlier than in engines having only the piston type intake port due to the existence of the auxiliary passages 18 having the reed type valves 27.

Figure 7:
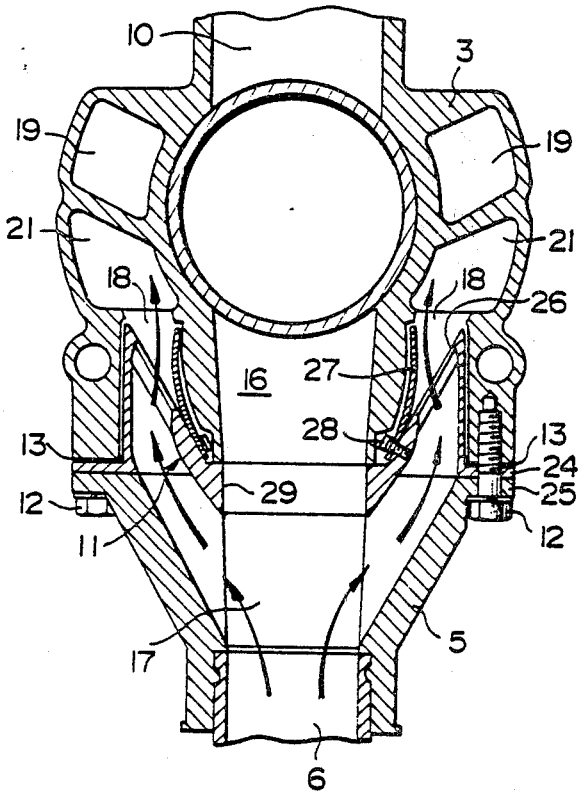
FIG. 7 is a sectional view similar to that of FIG. 3, but showing the flow of fuel mixture during the downward stroke of the piston.

Through the upward movement of the piston 4, the air-fuel mixture previously introduced into the combustion chamber 20 is compressed and ignited by the plug 1. Thus, combustion of the mixture takes place and piston 4 is forced downwards. In the downward movement of the piston 4, the exhaust port 10 is at first opened and the combustion gas is allowed to flow out of the combustion chamber 20. In this downward movement of the piston 4, the air-fuel mixture in the crankchamber 8 is compressed. Then, the piston comes to a position where the scavenging ports 22 and 23 are opened. Thus, the mixture is allowed to flow through the scavenging passages 19 and 21 and the scavenging ports 22 and 23 into the combustion chamber 20. Simultaneously, as illustrated in FIG. 7, air-fuel mixture is also admitted from the intake passage 17 through the auxiliary passages 18 and the reed type valves 27 to the scavenging passages 19 and 21 to be introduced into the combustion chamber 20.

It should therefore be noted that the total amount of intake mixture can be increased due to the existence of the auxiliary passages 18 for providing additional engine output. It should further be noted that the engine in accordance with the present invention can provide a satisfactory response in engine acceleration since it utilizes a piston type valve for introducing a substantial part of the intake mixture into the crankchamber. Although the foregoing descriptions have been made with respect to an engine having a carburetor in the intake passage so that the crankchamber is supplied with air-fuel mixture, the present invention can also be applied to engines wherein fuel is injected directly into the combustion chamber or into the scavenging passages.

Figure 4:
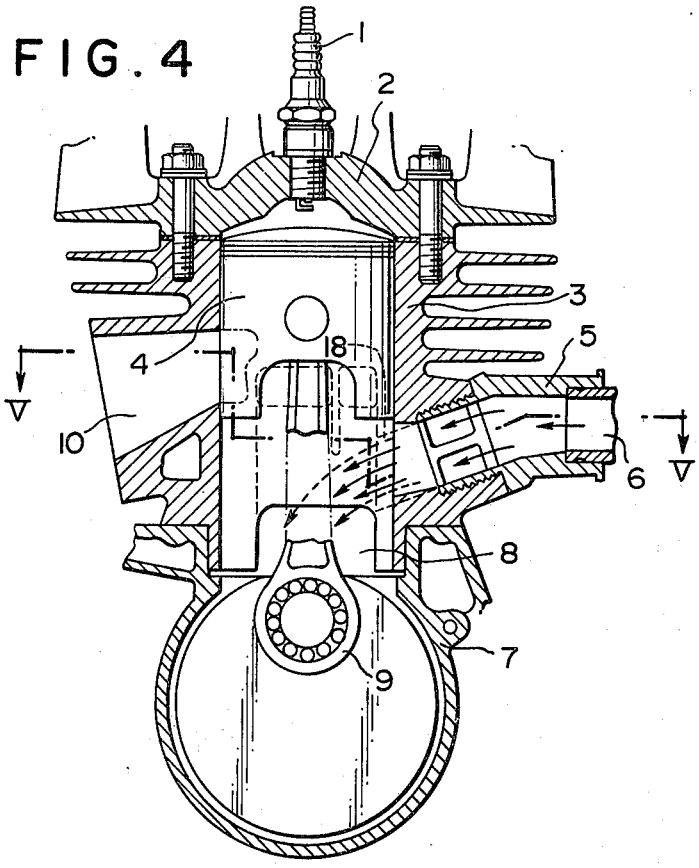
FIG. 4 is a sectional view of a two stroke engine in accordance with another embodiment of the present invention.
Figure 5:
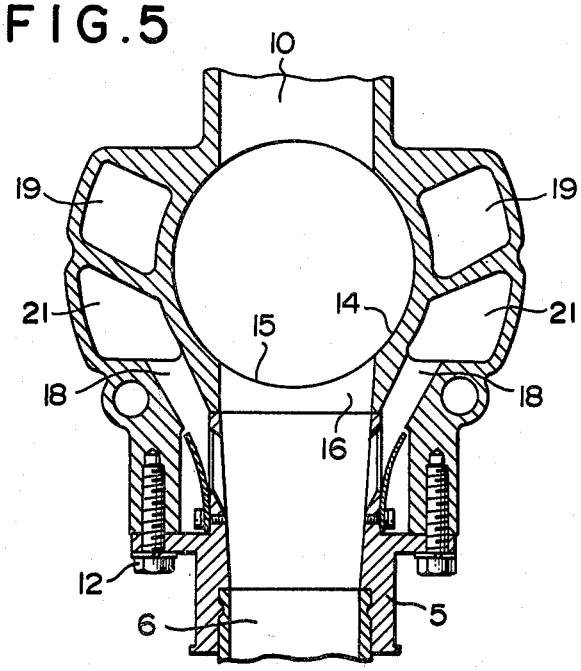
FIG. 5 is a sectional view taken substantially along the line V—V in FIG. 4.

FIGS. 4 and 5 show another embodiment of the present invention which is substantially identical with the previous embodiment os that corresponding parts are designated by the same reference numerals as in the previous embodiment. In this embodiment, however, the reed valve assembly is formed integrally with the conduit block 5 which has a flange 24 directly attached to the cylinder 3 by means of bolts 12.

The invention has thus been shown and described with reference to specific embodiments, however, it should be noted that the invention is in no way limited to the details of the illustrated structures but changes and modifications may be made within the scope of the appended claims.

I claim:

1. Two stroke engine comprising cylinder means, crankchamber means provided beneath the cylinder means, piston means disposed in said cylinder means for reciprocating movement, combustion chamber means defined in the cylinder means by said piston means, scavenging port means provided in said cylinder means and adapted to co-operate with said piston means so as to be cyclically opened to said combustion chamber means, scavenging passage means extending between said scavenging port means and said crankchamber means, intake port means provided in said cylinder means and adapted to co-operate with said piston means so as to be cyclically opened to said crankchamber means, intake passage means connected with said intake port means, auxiliary passage means extending between the intake passage means and said scavenging passage means and including one-way valve means which allows gas flow only toward the scavenging passage means.

2. Two stroke engine in accordance with claim 1 in which said one-way valve means is of a reed type.

3. Two stroke engine in accordance with claim 1 in which said intake passage means is provided with carburetor means for providing air-fuel mixture to be supplied into the combustion chamber means.

4. Two stroke engine in accordance with claim 1 in which said scavenging passage means includes at least two scavenging passages which are disposed at the opposite sides of the cylinder means and the auxiliary passage means includes corresponding number of branched passages respectively leading to the scavenging passages.

5. Two stroke engine in accordance with claim 4 in which said one-way valve means includes reed type valves respectively disposed in said auxiliary passages.

6. Two stroke engine in accordance with claim 5 in which said reed type valves are assembled in a single casing which is attached to the cylinder means.

7. Two stroke engine in accordance with claim 6 in which said casing is formed integrally with conduit block means providing said intake passage means.

8. A two stroke engine comprising:

a cylinder;

a crankchamber at one end of said cylinder;

a cylinder head at the other end of said cylinder;

a piston disposed in said cylinder for reciprocating movement therein;

a combustion chamber defined by said cylinder, said cylinder head and the head of said piston;

an intake port in said cylinder for admitting a fuel mixture to said crankchamber, said intake port being so located that it is cyclically opened to said crankchamber by the reciprocating movement of said piston;

a scavenging port in said cylinder for admitting fuel mixture to said combustion chamber, said port being so located that it is cyclically opened to said combustion chamber by the reciprocating movement of the said piston;

a scavenging passage connecting said scavenging port with said crankchamber;

an intake passage connecting said intake port with a source of fuel mixture;

an auxiliary passage connecting said intake passage and said scavenging passage;

a one-way valve in said auxiliary passage which permits fuel mixture flow only toward said scavenging passage.

* * * * *